US008052485B2

(12) United States Patent
Lee et al.

(10) Patent No.: US 8,052,485 B2
(45) Date of Patent: Nov. 8, 2011

(54) ELECTRICAL POWER OUTLET DEVICE AND MODULE THEREOF

(75) Inventors: Yu-Lung Lee, Nanjhuang Township, Miaoli County (TW); Jung-Hui Hsu, Sinjhuang (TW)

(73) Assignee: Powertech Industrial Co., Ltd., Chung Ho (TW)

( * ) Notice: Subject to any disclaimer, the term of this patent is extended or adjusted under 35 U.S.C. 154(b) by 0 days.

(21) Appl. No.: 12/622,650

(22) Filed: Nov. 20, 2009

(65) Prior Publication Data

US 2011/0086554 A1 Apr. 14, 2011

(30) Foreign Application Priority Data

Oct. 9, 2009 (TW) ..... 98134350 A

(51) Int. Cl.
*H01R 13/10* (2006.01)

(52) U.S. Cl. ..... 439/682

(58) Field of Classification Search ..... 439/682, 439/34, 38–39; 29/874, 876, 868, 747; 363/9.1, 363/13, 67; 307/13, 18; 361/31
See application file for complete search history.

(56) References Cited

U.S. PATENT DOCUMENTS

| | | | | |
|---|---|---|---|---|
| 4,507,720 | A * | 3/1985 | Colbrese | 363/13 |
| 5,428,288 | A | 6/1995 | Foreman et al. | |
| 6,411,053 | B1 * | 6/2002 | Dewey | 318/445 |
| 6,897,370 | B2 * | 5/2005 | Kondo et al. | 136/243 |

FOREIGN PATENT DOCUMENTS

| | | | |
|---|---|---|---|
| GB | 2274030 | A | 7/1994 |
| JP | 2006019188 | A | 1/2006 |

OTHER PUBLICATIONS

Keefe, Peter, Examiner, British Examination Report dated Mar. 10, 2011 for corresponding Application No. GB0920787.9, three pages.
Brown, Michael, Attorney, Response to British Examination Report dated Mar. 10, 2011 for corresponding Application No. 0920787.9, 19 pages.

* cited by examiner

*Primary Examiner* — Jean Duverne
(74) *Attorney, Agent, or Firm* — C. G. Mersereau; Nikolai & Mersereau, P.A.

(57) ABSTRACT

The present invention relates to an electrical power outlet device and a module thereof. The electrical power outlet device includes an electrical power outlet section and a main body section. The electrical power outlet section has an electrical power outlet unit with a plurality of sockets, and an electric plug is inserted into the sockets and is remained firmly in an electrical power outlet. The main body section is connected with the electrical power outlet section and has a circuit device and an output unit, wherein the circuit device is connected with the corresponding plurality of sockets of the electrical power outlet unit to receive a power signal and converts the power signal to produce a converted signal, and the output unit is connected to the circuit device to send out a converted signal.

4 Claims, 6 Drawing Sheets

ELECTRICAL POWER OUTLET DEVICE AND MODULE THEREOF

BACKGROUND OF THE INVENTION

1. Field of the Invention

The present invention relates to an electrical power outlet device, and more particularly to an electrical power outlet device which obtains electric power in a parallel mode.

2. Description of Related Art

With the popularity of all kinds of electronic devices, the average family has various electronic devices. Since various electronic devices each need a standard power outlet and the electronic devices are placed centralizedly, the average family always hasn't enough standard power outlets. So additional devices, such as power extension lines, outlet expansion sockets and so on, are usually connected to increase the number of the outlets. As a result, the environmental problems are generated and the additional devices are inconvenient to carry around or move positions.

Furthermore, in various portable devices, transformers are needed to convert alternating current power signals for charging the portable devices, so it also needs extra power outlets.

Conventional chargers mainly obtain alternating current power signals via combining electric power obtaining devices with household power outlets, convert the voltage via transformer circuits and stabilized voltage devices, and then send out a stable direct voltage and current via a transport interface. However, because the chargers generally have a large volume and may be twice as large as the size of a standard power outlet, it is still inconvenient for use in the average family.

SUMMARY OF THE INVENTION

An electrical power outlet device in accordance with an embodiment of the present invention is provided. The electrical power outlet device includes: an electrical power outlet section, having an electrical power outlet unit with a plurality of sockets, an electric plug inserted into the sockets and remained firmly in an electrical power outlet; and a main body section, connected with the electrical power outlet section and having a circuit device and an output unit, wherein the circuit device is connected with the corresponding plurality of sockets of the electrical power outlet unit and the output unit is connected to the circuit device to send out a converted signal.

An electrical power outlet device in accordance with an embodiment of the present invention is provided. The electrical power outlet device includes: an electrical power outlet section, having an electrical power outlet unit with a plurality of sockets, an electric plug inserted into the sockets and remained firmly in an electrical power outlet to obtain an alternating current power signal from the electrical power outlet; a main body section, receiving and processing the alternating current power signal, and sending out the alternating current power signal via an output unit; and a connecting device, connected between the electrical power outlet section and the main body section to send the alternating current power signal from the electrical power outlet section to the main body section.

A connecting method of an electrical power outlet device in accordance with an embodiment of the present invention is provided. The method includes the steps of: aligning a plurality of sockets of an electrical power outlet unit of an electrical power outlet section with an electrical power outlet, making an electric plug inserted into the plurality of sockets of the electrical power outlet unit and remained the electric plug firmly in the electrical power outlet so that the electrical power outlet unit is connected with the electrical power outlet by the electric plug; obtaining an alternating current power signal from the electrical power outlet and converting the alternating current power signal via a circuit device to produce a converted signal; and connecting an output unit with the circuit device to send out the converted signal.

DETAILED DESCRIPTION OF THE PREFERRED EMBODIMENTS

Figure 1A:
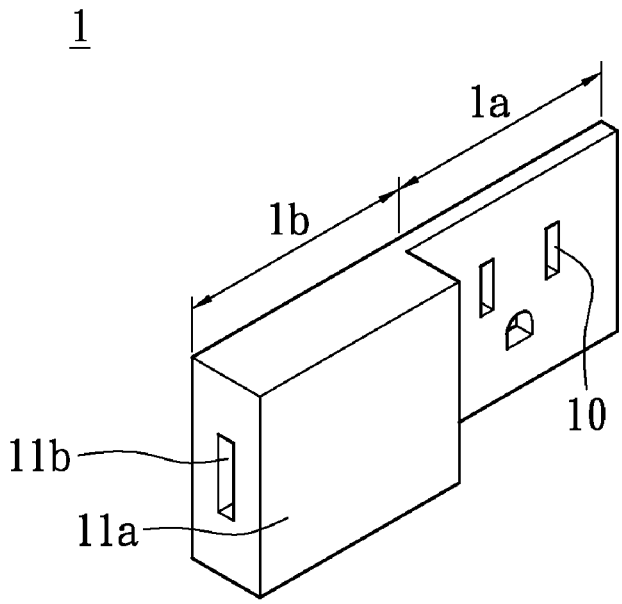
FIG. 1A and FIG. 1B are schematic views of an electrical power outlet device of a first embodiment according to the present invention.
Figure 1B:
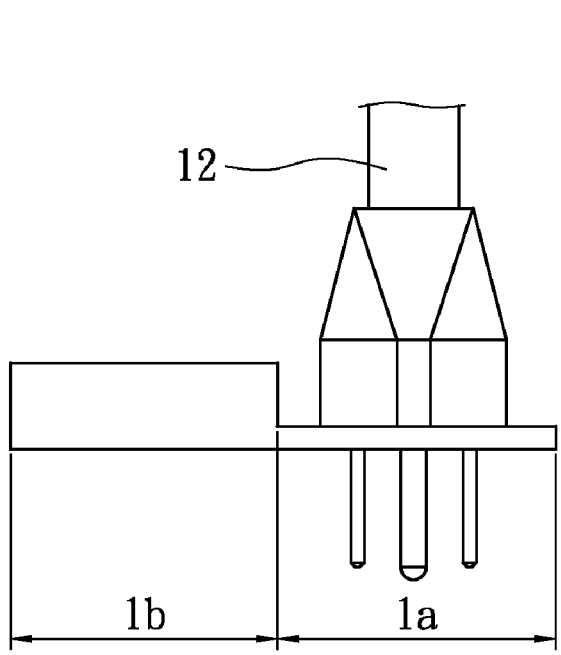
Figure 1C:
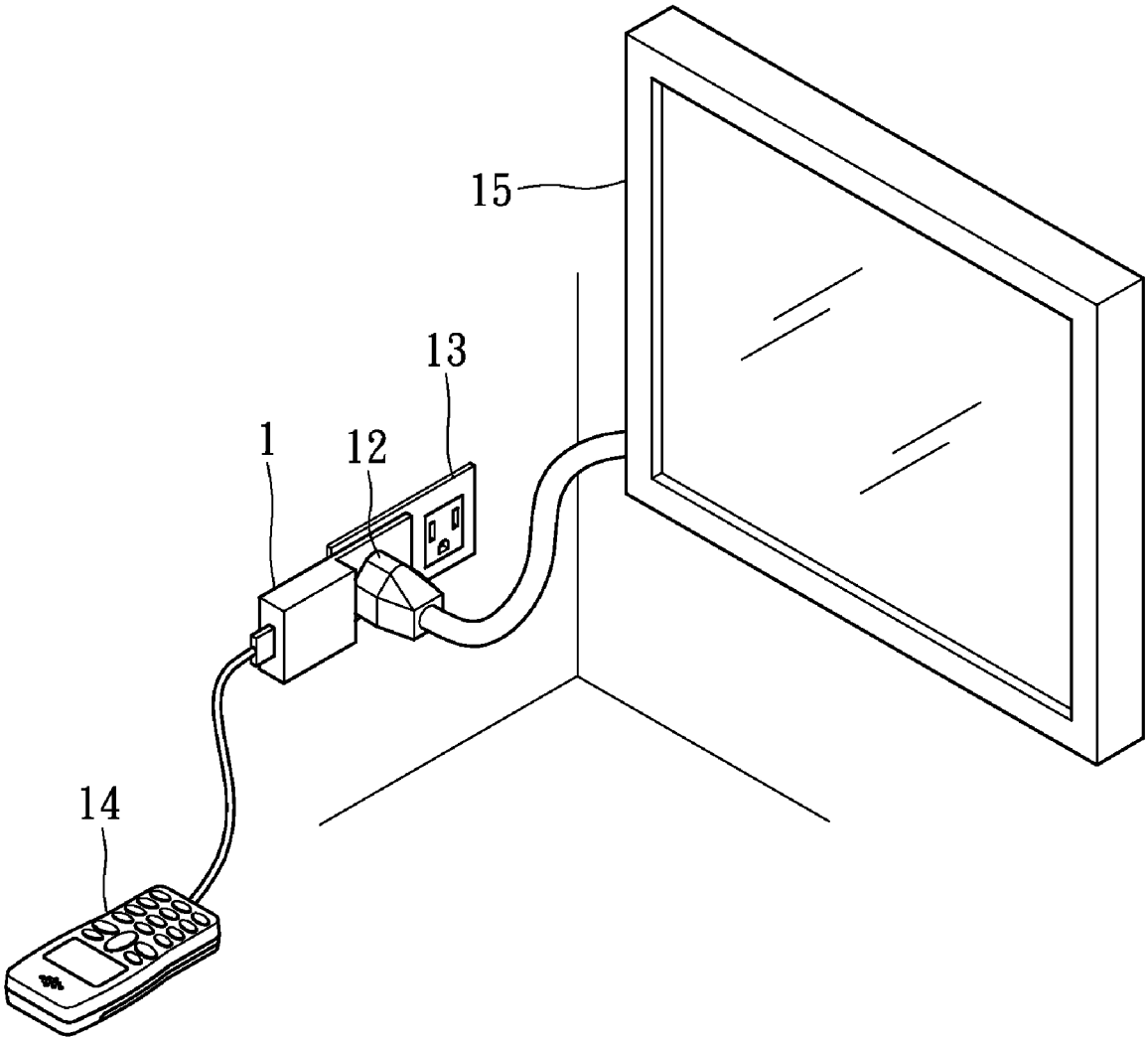
FIG. 1C is a schematic view of the electrical power outlet device of the first embodiment according to the present invention, in a used state.

Please refer to FIGS. 1A, 1B and 1C, an electrical power outlet device 1 has an electrical power outlet section 1*a* and a main body section 1*b*. The electrical power outlet section 1*a* has an electrical power outlet unit 10 for obtaining an alternating current power signal. The electrical power outlet unit 10 has a plurality of sockets which each is a punctured structure, and an electric plug 12 may puncture the sockets of the electrical power outlet unit 10 and be inserted and remained firmly in an electrical power outlet 13. In order that the electric plug 12 is remained in the electrical power outlet 13 securely, the electrical power outlet section 1*a* has a paper-thin structure. Further, the main body section 1*b* has a circuit device 11*a* and an output unit 11*b*, wherein the circuit device 11*a* performs a signal process action and produces a converted signal, and the output unit 11*b* receives a direct current power signal and sends out the direct current power signal.

A power obtaining structure of the electrical power outlet unit 10 may be one of conductors with a conductive function, such as a metal wire structure, an elastic piece structure, an elastic wire structure, a steel ball structure, a PCB, an electrical wire and so on, and may send an alternating current power signal to the main body section 1*b* through a tiny gap of the electrical power outlet section 1*a*. Accordingly, when the electric plug 12 is inserted into the plurality of sockets of the electrical power outlet unit 10, the electrical power outlet unit 10 may obtain electric power or transmit signals basing on the parallel connection of the electric plug 12 and the electrical power outlet 13.

The main body section 1*b* has the circuit device 11*a* and the output unit 11*b*. In the embodiment, the circuit device 11*a* is a transformer. The transformer is connected with the electrical power outlet unit 10 to obtain an alternating current power signal and then transforms and rectifies the alternating current power signal to produce a direct current power signal. The output unit 11*b* is connected with the circuit device 11*a* for receiving and sending out the direct current power signal. The output unit 11*b* is a USB interface, a socket, an electric plug or other output interfaces.

The electric plug 12 is inserted into the sockets of the electrical power outlet unit 10 and remained firmly in the electrical power outlet 13. The electric plug 12 may be connected with an electronic device, such as a LCD television 15, to provide a driving power to drive the electronic device. At the same time, the electrical power outlet device 1 receives an alternating current power signal via the electrical power outlet unit 10 and sends the alternating current power signal to the circuit device 11*a* to transform and rectify the alternating current power signal to produce a direct current power signal which is sent out by the output unit 11*b*. Finally, an electronic device, such as a mobile phone 14, may be connected with the output unit 11*b* by a transmission line to obtain the direct current power signal.

Figure 2:
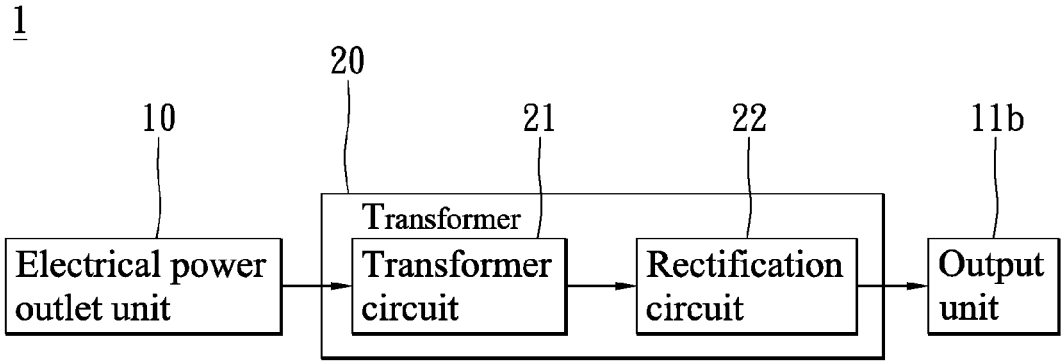
FIG. 2 is a block diagram of the electrical power outlet device of the first embodiment according to the present invention.

Please refer to FIG. 2, the electrical power outlet device 1 has an electrical power outlet unit 10, a transformer 20 connected with the electrical power outlet unit 10, and an output unit 11*b* connected with the transformer 20. The transformer 20 is the circuit device 11*a*. The electrical power outlet unit 10 is connected with the power outlet 13 by the electric plug 12 for receiving the alternating current power signal. The transformer 20 includes a transformer circuit 21 and a rectification circuit 22. The transformer circuit 21 is connected with the electrical power outlet unit 10 for receiving the alternating current power signal and then performing voltage conversion on the alternating current power signal to produce a transformed power signal. The rectification circuit 22 is connected with the transformer circuit 21 for receiving the transformed power signal and rectifying the transformed power signal to produce a direct current power signal. The output unit 11*b* is connected with the rectification circuit 22 of the transformer 20 for receiving and outputting the direct current power signal.

Figure 3A:
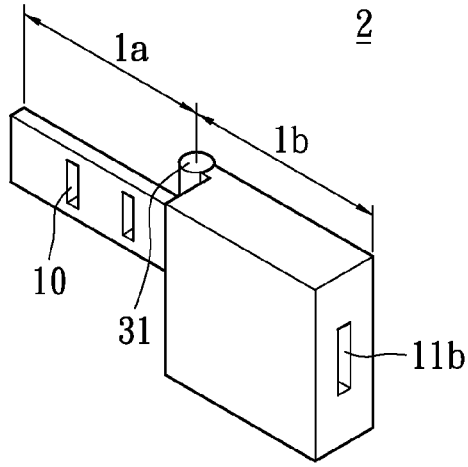
FIG. 3A, FIG. 3B, FIG. 3C, FIG. 3D, FIG. 3E and FIG. 3F are structural schematic views of the electrical power outlet device of the first embodiment according to the present invention.

As shown in FIG. 3A, an electrical power outlet section 1*a* and a main body section 1*b* of an electrical power outlet device 2 are connected by a connecting device. In the embodiment, the connecting device may be a rotating hinge 31. In the tiny gap of the rotating hinge 31, the electrical power outlet unit 10 and the transformer 20 are connected via a metal wire structure, an elastic piece structure, an elastic wire structure, a steel ball structure, a PCB, a soft circuit, an electrical wire and so on. Thus, based on the rotating hinge 31, the electrical power outlet device 2 may be folded and received.

Figure 3B:
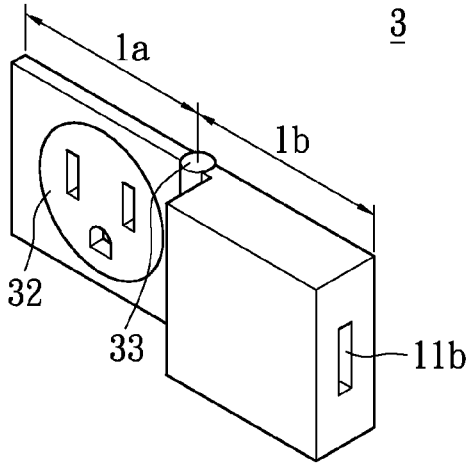

As shown in FIG. 3B, an electrical power outlet unit 10 of an electrical power outlet section 1*a* of an electrical power outlet device 3 may be a rotatable outlet structure 32. Accordingly, when users connect the electrical power outlet unit 10 of the electrical power outlet device 3 with the power outlet 13 and the electric plug 12, the electrical power outlet unit 10 may rotate 360° basing on the rotatable outlet structure 32, so that the main body section 1*b* can be freely adjusted in various directions. Further, a connection device is connected between the electrical power outlet section 1*a* and the main body section 1*b*. In the embodiment, the connection device may be a rotating hinge 33, so the electrical power outlet device 3 may be folded and received.

Figure 3C:
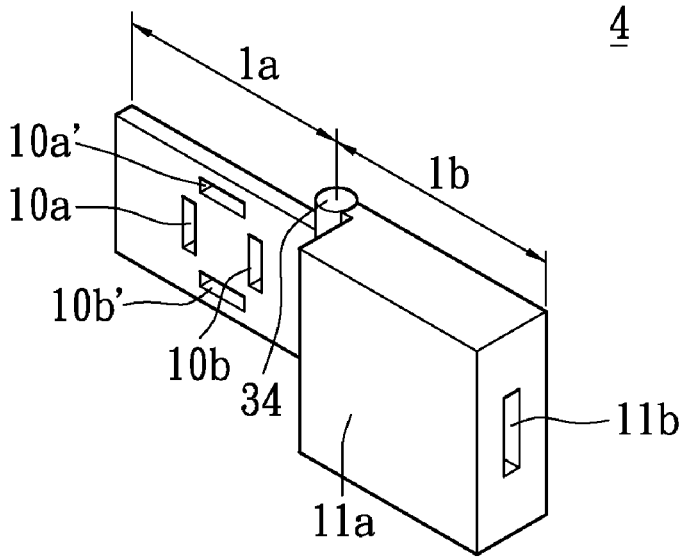

As shown in FIG. 3C, the electrical power outlet section 1*a* has first electrical power outlets 10*a*, 10*b* and second electrical power outlets 10*a*', 10*b*', and the sockets of the first electrical power outlets 10*a*, 10*b* and the sockets of the second electrical power outlets 10*a*', 10*b*' have different orientations so that the main body section 1*b* can be adjusted in various directions. In the embodiment, the first electrical power outlets 10*a*, 10*b* and the second electrical power outlets 10*a*', 10*b*' are in perpendicular directions, so they can be used in different directions to improve the degree of convenience of use. Basing on the spirit of the present invention, the present invention may also have many groups of outlets in different directions, so the present invention can have many use directions for use. Further, a connection device is connected between the electrical power outlet section 1*a* and the main body section 1*b*. In the embodiment, the connection device may be a rotating hinge 34, so the electrical power outlet device 4 may be folded and received.

Figure 3D:
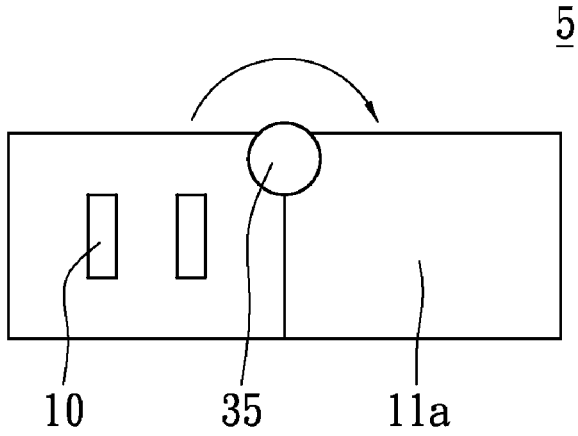

As shown in FIG. 3D, an electrical power outlet section 1*a* and a main body section 1*b* of an electrical power outlet device 5 may be connected by a connection device. In the embodiment, the connection device may be a rotating hinge 35 which ensures that the electrical power outlet section 1*a* and the main body section 1*b* are in a horizontal-rotating movement relationship. Accordingly, the electrical power outlet device 5 may be folded and received in a horizontal-rotating mode.

Figure 3E:
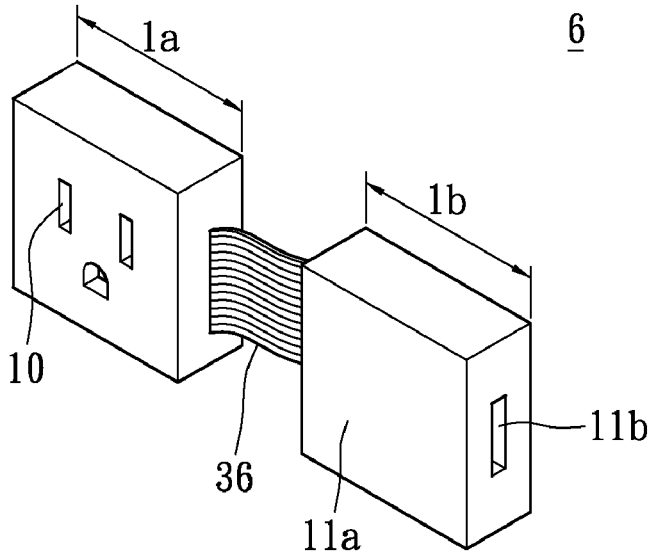

As shown in FIG. 3E, an electrical power outlet section 1*a* and a main body section 1*b* of an electrical power outlet device 6 may be connected by a connection device. In the embodiment, the connection device may be a soft circuit board 36 or other similar online devices. A fixing structure (not shown), which may be a double-sided tape, a hook and loop fastener, a magnet or a fastening tenon etc., may be disposed on one side of the main body section 1*b*. In the embodiment, the connection device may also be a connection wire, an electrical wire and so on. Accordingly, the main body section 1*b* and the electrical power outlet section 1*a* of the electrical power outlet device 6 may have online and extension functions, so that users can connect the electrical power outlet section 1*a* with the power outlet 13 via the electric plug 12 and fasten the main body section 1*b* firmly in any position via the connection device which is formed by the soft circuit board 36 and the fixing structure, thereby improving the degree of convenience of use.

Figure 3F:
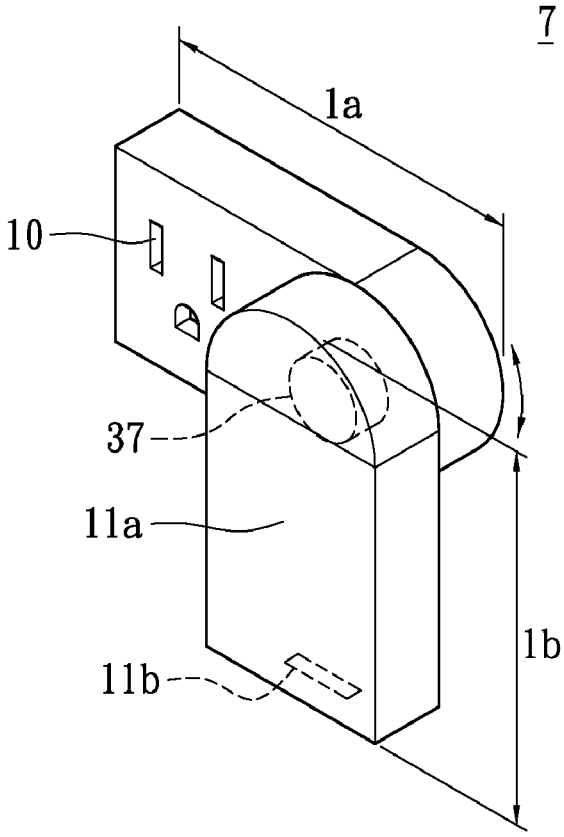

As shown in FIG. 3F, an electrical power outlet section 1*a* and a main body section 1*b* of an electrical power outlet device 7 are connected by a connecting device. In the embodiment, the connecting device may be a rotating hinge 37 which may be hidden between the electrical power outlet section 1*a* and the main body section 1*b* so that the electrical power outlet section 1*a* may rotate and move to the lower of the main body section 1*b* for being folded and received basing on the rotating hinge 37.

Figure 4:
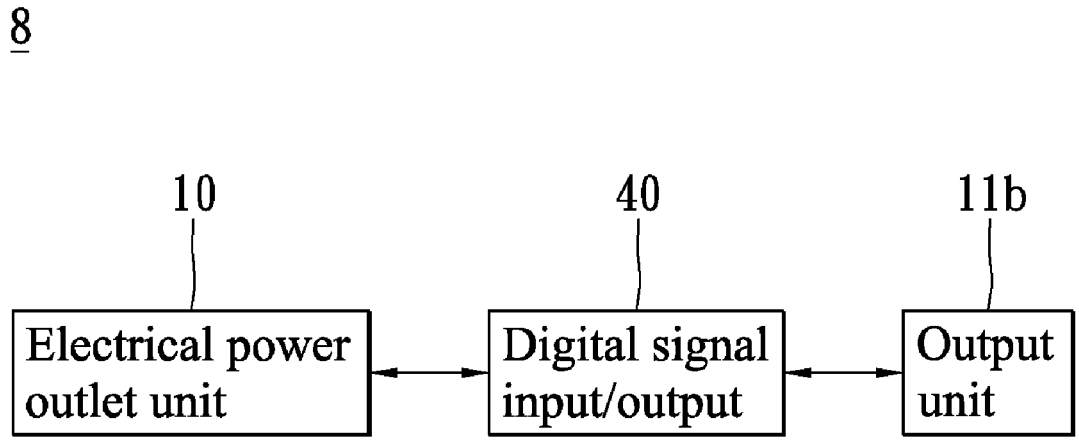
FIG. 4 is a block diagram of an electrical power outlet device of a second embodiment according to the present invention.

Please refer to FIG. 4, an electrical power outlet device 8 has the same appearance with those of the above-mentioned electrical power outlet devices. The circuit device 11*a* is a digital signal input/output interface 40 for receiving a digital signal, converting the digital signal and loading it on the alternating current power signal, and transmitting the digital signal via an electric wire. In the same way, the digital signal input/output interface 40 may also receive an alternating current power signal via the electric wire and restore the digital signal loaded on the alternating current power signal. Accordingly, a plurality of electrical power outlet devices 8 and electric wires disposed all around a building can be used to form an electric wire network to transmit digital signals. The output unit 11*b* may be one or a plurality of RJ-45 interfaces for the input/output of a digital signal into/from an electronic device (for example, a computer). Also, the output unit 11*b* may be a HDMI (RTM) interface, a DVI (RTM) interface, an S terminal and so on.

In the embodiment, users can use more than two electrical power outlet devices 8 to form an electric wire network with electric wires in a building for transmission of digital signals.

The electrical power outlet devices 8 may have the appearance as shown in FIGS. 3A-F, so the electrical power outlet devices 8 may be electric wire network bridges and may be folded and received.

Figure 5:
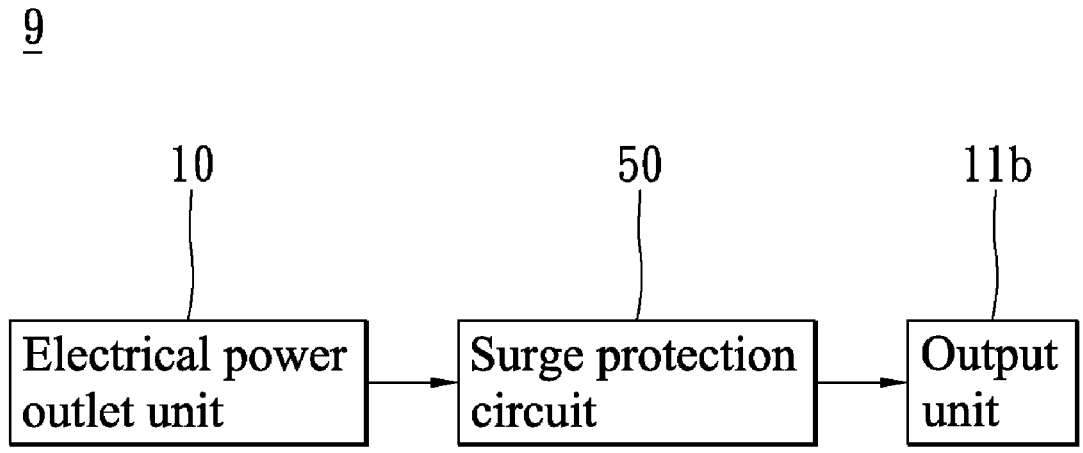
FIG. 5 is a block diagram of an electrical power outlet device of a third embodiment according to the present invention.

As shown in FIG. 5, an electrical power outlet device 9 may have the same appearance with those of the above-mentioned electrical power outlet devices. The circuit device 11*a* may be a surge protection circuit 50, and the electrical power outlet unit 11*b* may be any one of transmission interfaces such as an electric plug, a socket, a USB interface and so on. Since high voltage or high current surge signals always occur, the electrical power outlet device 9 have a function of surge protection.

When the electrical power outlet device 9 is connected with the power outlet 13 by the electric plug 12, an alternating current power signal is transmitted to the surge protection circuit 50 through the electrical power outlet unit 10. If a surge signal occurs, the surge protection circuit 50 stops the surge signal immediately, thereby ensuring that the output unit 11*b* and the electric plug 12 can still send out stable electric power signals to protect electronic devices connected therewith from being damaged. If the surge signal is too high and the electrical power outlet device 9 cannot stop the surge signal, then the electrical power outlet device 9 will be damaged, but electronic devices connected with the electrical power outlet device 9 can be protected from being damaged by the surge signal.

The electrical power outlet device 9 may also have the appearance as shown in FIGS. 3A-3F, so the electrical power outlet device 9 can be folded and received for convenient of carry and use.

Please refer to FIG. 2, FIG. 3 and FIG. 5, the circuit device 11*a* may also be the combination of a transformer 20 and a surge protection circuit 50, thereby forming a transformer with a function of surge protection. Additionally, the circuit device 11*a* may also be the combination of a surge protection circuit 50 and a digital signal input/output interface 40, thereby forming an electric wire network bridge device with a function of surge protection.

What is claimed is:

1. A method of connecting an electrical power outlet device having an electrical power outlet unit, comprising steps of:

aligning a plurality of sockets located on an electrical power outlet section of the electrical power outlet unit with an electrical power outlet, inserting an electric plug into the electrical power outlet through the plurality of sockets of the electrical power outlet unit wherein the electric plug when inserted into the sockets of the electrical power outlet unit is firmly secured in the electrical power outlet so that the electrical power outlet unit is connected with the electrical power outlet by the electric plug;

obtaining an alternating current power signal from the electrical power outlet from the electrical power outlet unit and converting the alternating current power signal via a circuit device connected with the electrical power outlet unit to generate a converted signal; and connecting an output unit with the circuit device to send out the converted signal.

2. The method as claimed in claim 1, wherein the circuit device is at least one of a transformer circuit, a digital signal input/output interface or a surge protection circuit.

3. The method as claimed in claim 1, wherein the electrical power outlet unit and the circuit device are connected by a connecting device which is a rotating hinge, a soft circuit board, a connecting wire or an electrical wire, and when the electrical power outlet unit is connected with the circuit device by the rotating hinge, the electrical power outlet unit is connected with the circuit device via a metal wire structure, an elastic piece structure, an elastic wire structure, a steel ball structure, a PCB or an electrical wire passing through a gap of the rotating hinge.

4. The method as claimed in claim 1, wherein the output unit is at least one of a USB interface, a RJ45 interface, a HDMI (RTM) interface, a DVI (RTM) interface, an S terminal, an electric plug or a socket.

* * * * *